United States Patent [19]

Edwards

[11] Patent Number: 4,617,808

[45] Date of Patent: Oct. 21, 1986

[54] OIL SEPARATION SYSTEM USING SUPERHEAT

[76] Inventor: Thomas C. Edwards, 1426 Gleneagles Way, Rockledge, Fla. 32955

[21] Appl. No.: 808,650

[22] Filed: Dec. 13, 1985

[51] Int. Cl.[4] ..... F25B 43/02

[52] U.S. Cl. ..... 62/472; 62/468; 62/513

[58] Field of Search ..... 62/84, 470, 471, 472, 62/513, 113, 468

[56] References Cited

U.S. PATENT DOCUMENTS

| | | | |
|---|---|---|---|
| 1,272,378 | 7/1918 | Collins | 60/671 |
| 2,345,950 | 4/1944 | Salzmann | 60/660 |
| 3,040,528 | 6/1962 | Tabor et al. | 60/36 |
| 3,210,553 | 10/1965 | Cummings | 290/4 |
| 3,457,722 | 7/1969 | Bush | 60/24 |
| 3,584,457 | 6/1971 | Davoud | 60/36 |
| 3,744,245 | 7/1973 | Kelly | 60/95 |
| 3,788,064 | 1/1974 | Hawkins | 60/36 |
| 3,878,683 | 4/1975 | Imai | 60/647 |
| 4,191,021 | 3/1980 | Nakamura et al. | 60/637 |
| 4,292,809 | 10/1981 | Bjorklund | 60/676 |
| 4,326,301 | 4/1982 | Sato et al. | 62/402 |
| 4,326,391 | 4/1982 | Sato et al. | 62/470 |
| 4,434,626 | 3/1984 | Schmidt | 62/470 |
| 4,437,308 | 3/1984 | Fischer | 60/514 |

FOREIGN PATENT DOCUMENTS

| | | |
|---|---|---|
| 3032921 | 4/1982 | Fed. Rep. of Germany . |
| 54-114653 | 6/1979 | Japan . |

*Primary Examiner*—Ronald C. Capossela

*Attorney, Agent, or Firm*—Leydig, Voit & Mayer, Ltd.

[57] ABSTRACT

A combination superheater and oil separator for a refrigeration system having a rotary component, a source of heated medium and a source of non-superheated refrigerant gas-oil mixture includes a sealed casing, a heat transfer unit within the casing having a heat transfer surface, a connection from the interior of the casing to receive the mixture from the source, a connection from the heat source to supply heated medium at a temperature and heat transfer rate through the heat transfer surface to boil off refrigerant gas from the mixture and produce superheated refrigerant gas, a connection on the interior of the casing to deliver superheated refrigerant gas boiled off from the mixture in the interior of said casing, and a delivery conduit to deliver oil from the casing to the rotary component for lubricating the component with the nondiluted oil.

5 Claims, 6 Drawing Figures

OIL SEPARATION SYSTEM USING SUPERHEAT

TECHNICAL FIELD

This invention relates to the separation of oil from refrigerant gas-oil mixture, in refrigeration systems.

BACKGROUND ART

In the production of power from a system using a Rankine cycle, it is proposed to use a power generation unit capable of being used anywhere a source of low-grade thermal energy is available as a heat source and employing an organic fluid as the working fluid in the unit. Such a power unit is capable of producing output power in a relatively low range, such as 1-5 kilowatts where the output is electrical power, while operating efficiently.

As disclosed in copending U.S. application Ser. No. 804,400, filed Dec. 4, 1985, entitled "Power Unit For Converting Heat To Power", such a power unit using an organic Rankine cycle with refrigerant as the working fluid has a constrained, rotary vane expander as a power output unit, a boiler to produce pressurized vapor for operating the expander, a condenser to condense the exhausted vapor, hot and cold side heat exchange circuits, and simple controls for operating the unit when producing power output from a wide possibility of locally available heat sources.

With this system, oil may be injected into the expander for lubrication where it is mixed with refrigerant. An oil separator is provided to separate the oil from the refrigerant.

DISCLOSURE OF THE INVENTION

The principal object of this invention is to ensure lubrication of the rotary expander with non-diluted oil by boiling out the liquid refrigerant from the oil-refrigerant mixture, leaving only undiluted oil for injection into the rotary expander for lubrication purposes and, thereby, eliminating the need for a lubrication pump.

BEST MODE FOR CARRYING OUT THE INVENTION

Figure 1:
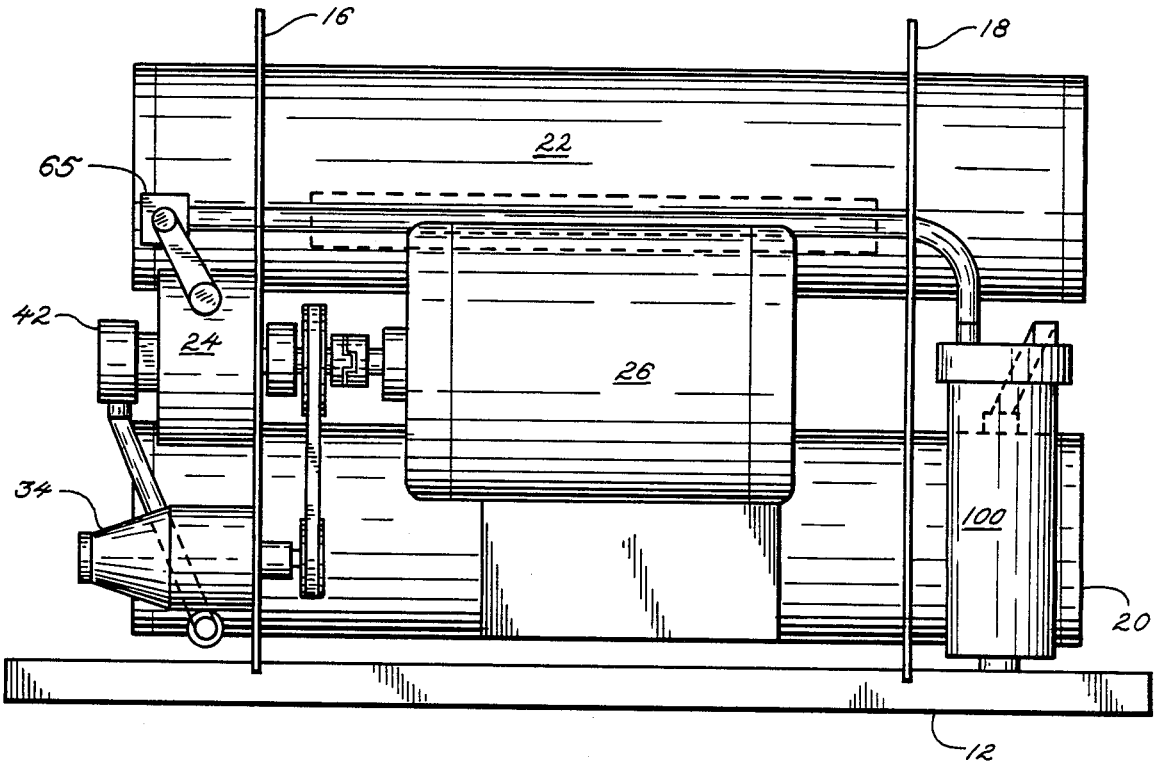
FIG. 1 is side view of a transportable frame mounted power unit with an oil separator which embodies the present invention.
Figure 2:
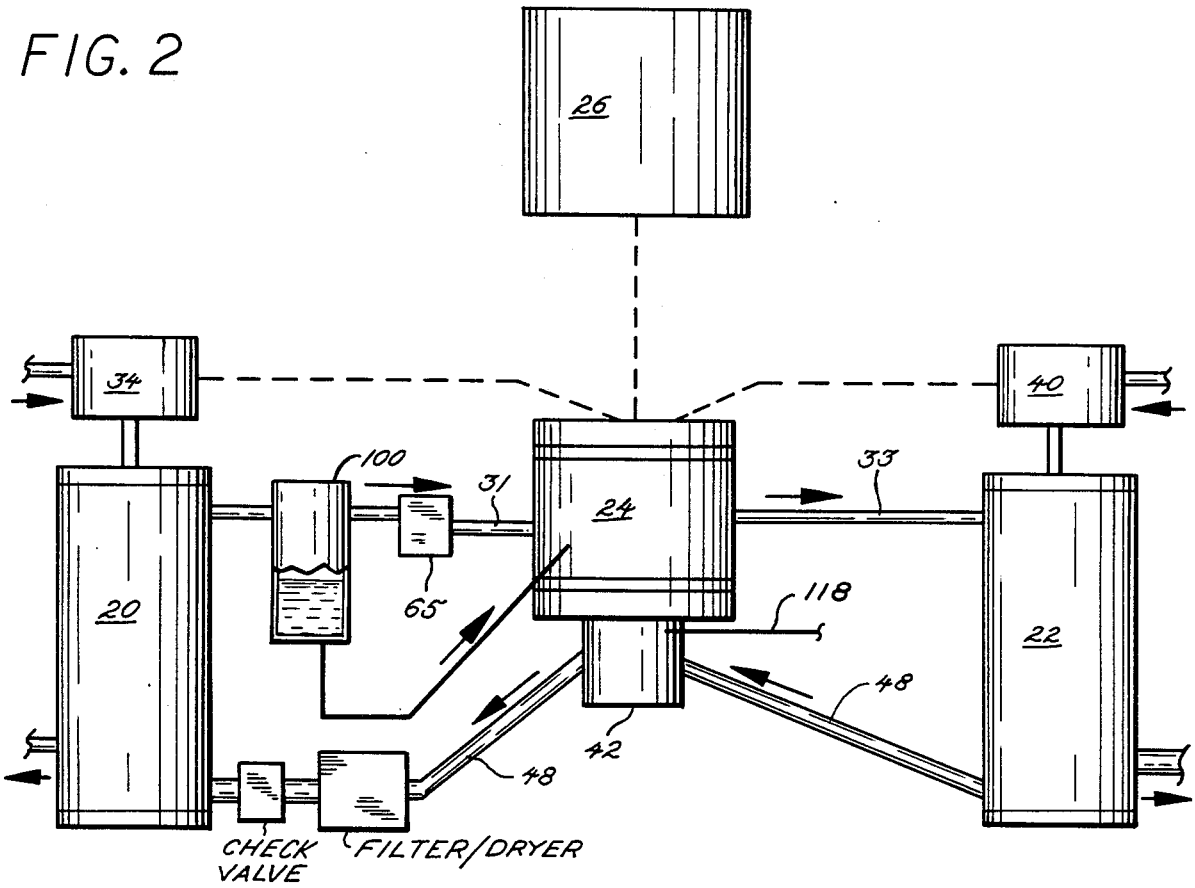
FIG. 2 is a block diagram illustrating system arrangement, fluid flow paths, and locating the oil separator according to the invention.
Figure 3:
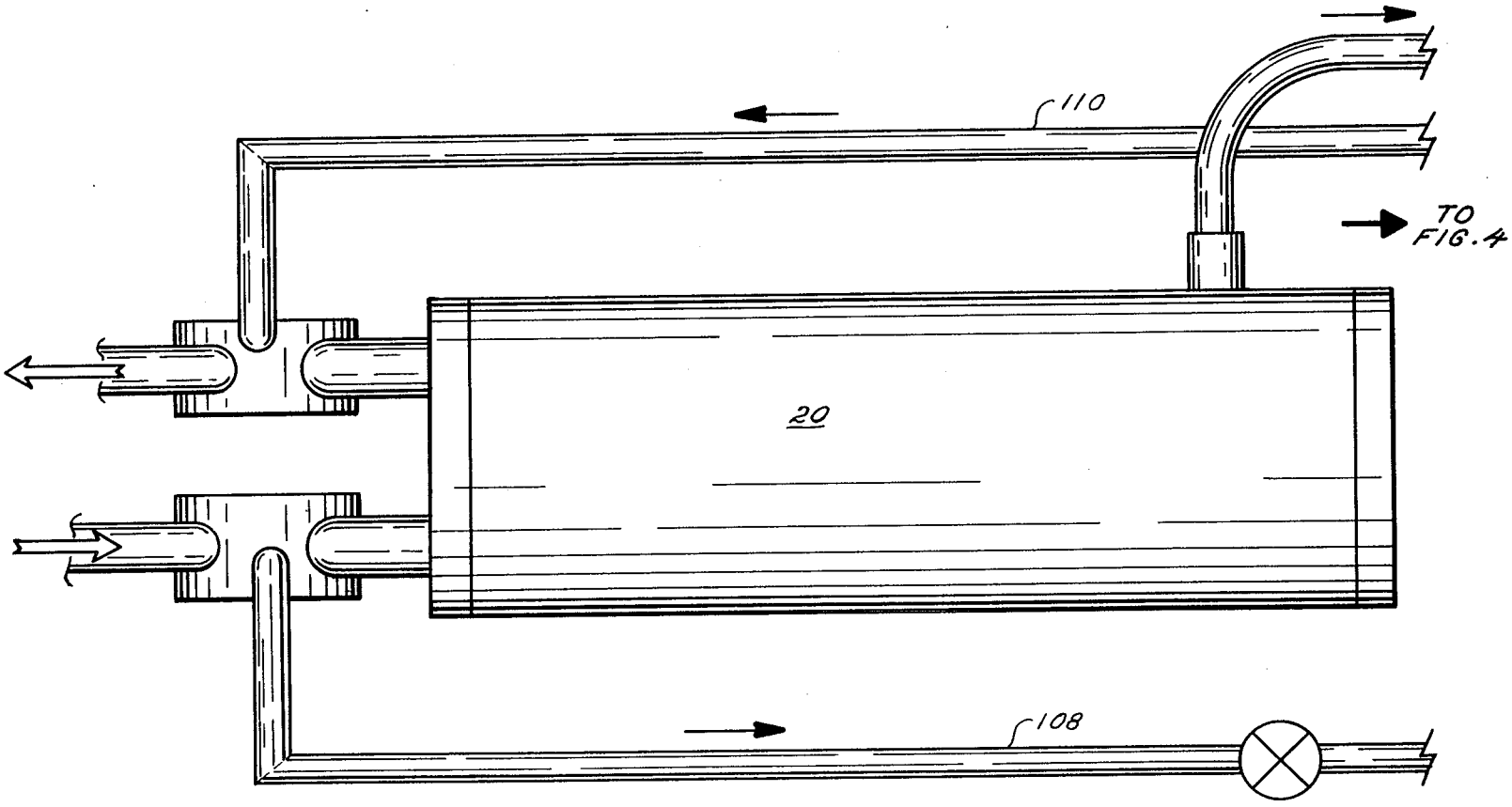
FIGS. 3 and 4, taken together, comprise a schematic diagram of the system shown in FIG. 2.

Turning to FIGS. 1 and 2, it can be seen that a power unit constructed according to the invention includes a frame comprised of channel members 12 and vertical plates 16, 18, welded or otherwise fixed to the channel members 12, and components mounted on the plates of the frame including an organic boiler 20, a condenser 22, an expander 24, and an energy conversion unit 26 driven by the expander 24. A hot side heat exchanger is associated with the boiler 20, a cold side heat exchanger is associated with the condenser 22, and conduits are provided interconnecting the components. The boiler

20 and condenser 22 are mounted horizontally on the vertical plates 16, 18, each having an end on one side (the left side in FIG. 1) of one of the vertical plates 16. The conduits connecting these components are also primarily located on the left side of the vertical plate 16 and connect to the projecting ends of the boiler and condenser for attachment to the heat exchangers associated therewith and internal chambers included in the refrigerant circuit.

Referring to FIG. 2, it will be seen that the organic boiler 20, expander 24, and condenser 22 components are constructed and arranged to employ a Rankine cycle. In carrying out the cycle, a working fluid, preferably a refrigerant such as Freon R11 or R114, is heated in the organic boiler 20 to produce pressurized refrigerant vapor at the temperature $T_1$ and pressure $P_1$ which is supplied through the inlet line 31 to drive the rotary expander 24 in which the vapor is adiabatically expanded to the pressure $P_2$, thereby generating usable power by turning the output shaft of the rotary expander 24. The working fluid vapor exhausted from the expander 24 through the outlet line 33 enters the condenser 22 where it is cooled, condensed and subsequently returned as a liquid through the action of the liquid feed pump 42 to the boiler 20, thereby completing the thermodynamic cycle.

The liquid working fluid is heated and changed in phase to pressurized vapor or gas in the organic boiler 20 due to heat transfer from a medium heated at a heat source and circulated through the hot heat exchanger which is connected in a hot side heat exchange circuit. A circulating pump 34 is used to circulate a previously heated heat exchange medium through the heat exchanger. The heated medium is supplied through conduits readily connected to the inlet and outlet fittings of the hot heat exchanger which is within the outer shell of the boiler 20. Where hot medium is available with sufficient head to circulate through the hot heat exchanger 28, the pump 34 can be eliminated or bypassed to reduce the power otherwise diverted to drive the pump.

A previously cooled heat exchange medium is similarly circulated through a cold heat exchange circuit associated with the condenser 22. A second circuit circulating pump 40 circulates the cooling medium through the conduits and inlet and outlet fittings of the cold side heat exchanger, which is within the outer shell of the condenser 22, to cool and condense the working fluid vapor in the condenser 22. Where the cooling medium has sufficient head, the pump 40 can be eliminated or bypassed.

While the power produced by the rotation of the expander 24 may be usefully applied through various energy conversion means, such as a take-off gearbox or shaft or pump, it is preferred to utilize an electric generator or alternator 26 driven from the output shaft of the expander 24 and mounted on one of the side plates 16 of the frame. Also mounted through and supported by one of the side plates 16 are the two circulating pumps 34, 40 for the heat exchange circuits, these pumps being belt driven from the output shaft of the expander 24. The rotary expander itself is also mounted and supported by one of the side plates 16. A liquid feed pump 42 is mounted on the outer face of the expander 24 to pump liquid refrigerant through the return line 48 from the condenser 22 to the boiler 20.

In carrying out the invention, it is preferred to use a highly efficient, positive displacement expander of the constrained, rotary vane type disclosed in U.S. Pat. Nos. 4,299,097 and 4,410,305. Other positive displacement expanders may be used, such as Wankel or Scroll rotor machines. Such positive displacement machines have constrained rotors so that rotor-to-housing clearances may be maintained, allowing use of low vapor pressure refrigerants, although high vapor pressure refrigerants may be required in some positive displacement machines for efficient operation. Use of the highly efficient constrained rotary vane machine disclosed in the aforesaid patents allows reduction in system complexity because regeneration is not required since it returns a small increase in performance, and the machines are insensitive to the presence of liquid droplets because the expansion process is independent of velocity (momentum) changes. The physical expansion of the vapor is the basis of the energy conversion process. Oil is injected into the expander to lubricate the vanes and it is preferred to separate the oil from the refrigerant vapor-oil mixture leaving the expander after it has been circulated through the system.

Operation in the superheat region is desired, according to the invention, to produce superheated refrigerant vapor to carry out the function of oil separation. In carrying out the invention, oil is separated on the high pressure side of the system to provide undiluted oil to lubricate the expander at the highest pressure in the loop. Being separated on the high pressure side, it is possible to avoid the need for an oil pump to raise the oil pressure to the higher pressures existing in the expander. The separation from the working fluid (preferably R-114) on the high pressure side is preferably immediately downstream of the boiler 20. At this location in the system, almost all the working fluid is in a gaseous phase.

In carrying out the invention, enough heat is transferred to a combination superheater and oil separator 100 to ensure that only superheated vapor emerges from the separator 100 while leaving the concentrated oil behind. With this arrangement, oil will circulate continuously throughout the system and somewhat negatively affect the heat transfer capacity of the boiler and condenser due to the insulation effect of the thin oil film. However, the same dilute oil-refrigerant mixture will pass through the liquid feed pump 42 and help lubricate it to offset the negative effect on heat transfer capacity. The separator 100 helps to solve the problem of providing good machine lubrication and sealing so as to not only increase net power output but also to ensure maximum longevity of the rotating components of the power unit, specifically the expander.

Figure 4:
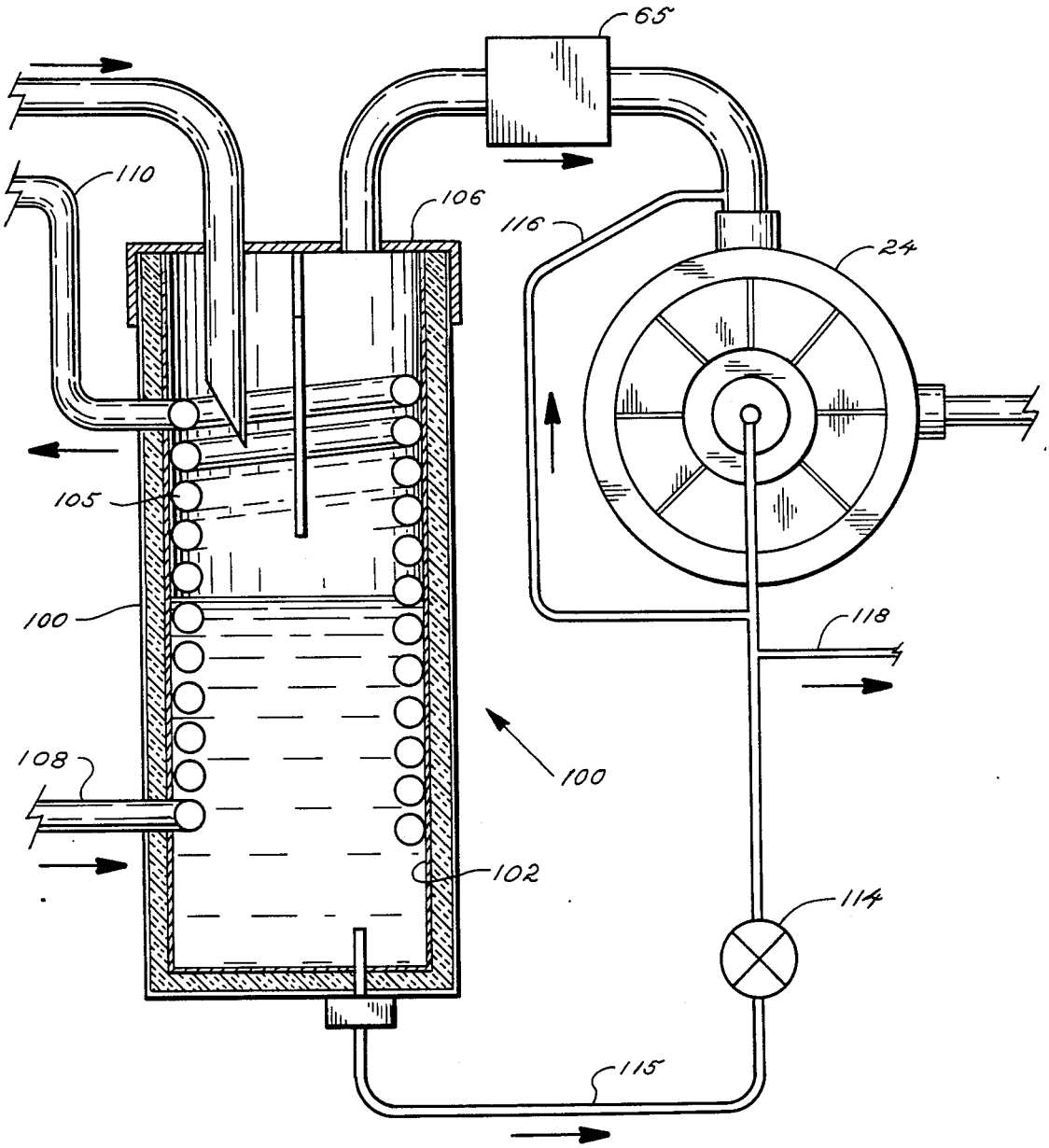
Figure 6:
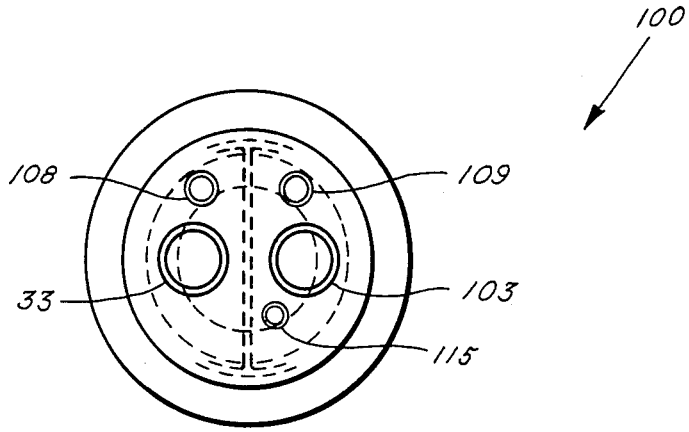
FIG. 6 is a top view of the unit shown in FIG. 5.
Figure 5:
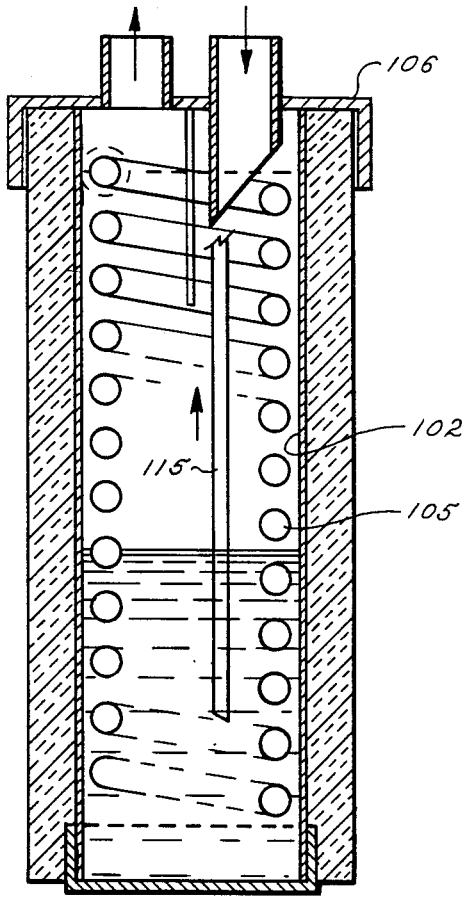
FIG. 5 is a cross-sectional view of a preferred embodiment of an oil separation unit employing the invention.

Now turning to FIGS. 4–6, for the purpose of providing a separator 100 serving as a combination superheater and oil separator, a casing or shell 102 is provided which receives refrigerant vapor from the boiler through the conduit 33, superheats the refrigerant vapor within the inside of the shell 102 and supplies the superheated vapor through the conduit 103 to the inlet of the expander 24. To superheat the non-superheated refrigerant vapor received from the boiler, an internal coil 105 providing a heat transfer surface is placed inside the separator shell 102. The shell 102 has a bolt-on top 106. In order to provide means for connecting a heat source to supply heated medium at a temperature and heat transfer rate through said heat transfer surface to boil off refrigerant gas from said mixture and produce superheated refrigerant gas, the internal coil 105 is connected to the hot water inlet 107 to the boiler through a conduit 108, and a return line 109 from the coil 105 is connected to the hot water outlet conduit 110 from the boiler 20. Both connections are preferably through the top 106 as seen in FIGS. 5 and 6.

To provide a suitable coil for a separator shell 102 of approximately 4 inch inside diameter, the coil can be wrapped on a substantially 2 inch diameter mandrel and then inserted inside the shell 102 of the separator 100. Using a 1 inch pitch, about 10 feet of tubing can be provided for inside a separator shell having an inside length of approximately 1 foot. This amount of tubing yields about 1.5 square feet of surface area to transfer heat to "boil out" the refrigerant and leave the oil behind to lubricate the machine. The oil collects in the bottom regions of the inside of the shell 102. When more than 1.5 square feet of surface area is required to effectively superheat the discharge from the boiler, a shallow-fin tubing ($\frac{1}{4}$ inch to $\frac{3}{8}$ inch high) may be used to increase the surface area by a factor of 5 or so. It is important also to keep the pressure drop on the water side of the superheating coil 105 low enough so that a throughput can be provided of 2–3 gpm of water flow with a head loss of no more than about 4–6 feet of water for a unit so sized.

The separator 100 is fed from the output of the boiler 20 on the righthand side, as viewed in FIG. 5. In turn, the superheated vapor will flow to the right (FIG. 4) to the throttle valve 65 and then to the inlet of the expander 24.

The oil remaining from the boil off of superheated refrigerant vapor from the mixture of refrigerant vapor and oil is collected in the bottom section of the casing or shell 102. The oil output from the separator 100 will be primarily routed to the "crankcase" of the rotary expander 24 through an outlet line 115 and a valve 114 for flow control. However, some of the oil is permitted to travel to the inlet of the expander 24 as well by means of a small line 116 to the inlet or by other similar means. Experience has shown that inlet oil mist will not only increase efficiency somewhat of the expander but also will reduce aerodynamic noise. In addition, if it is desired to do so, the liquid feed pump 42 may be lubricated by running a small line 118 to the back of the pump.

Preferably a float valve or similar device (not shown) is provided in the casing or shell 102 connected to a level control for maintaining a predetermined level in the casing, and the outler line 115, which preferably (see FIG. 5) comes into the casing 102 through the top 106, extends to below that level. The high side pressure forces the oil to the expander under control of the valve 114 which may be operated by the level control.

I claim:

1. A combination superheater and oil separator for a refrigeration system having a source of heated medium and a source of non-superheated refrigerant gas-oil mixture comprising:

a sealed casing;

a heat transfer unit within said casing having a heat transfer surface;

means on said casing for connecting the interior of said casing to receive said mixture from said source thereof;

means for connecting said heat source to supply heated medium at a temperature and heat transfer rate through said heat transfer surface to boil-off refrigerant gas from said mixture and produce superheated refrigerant gas;

means on said casing for connecting the interior of said casing to deliver superheated refrigerant gas boiled off from said mixture in the interior of said casing;

means on said casing below a predetermined level for connecting the interior of said casing to deliver oil remaining from the boil-off of super-heated refrigerant vapor from said mixture.

2. The combination superheater and oil separator according to claim 1 wherein said casing comprises an insulated cylindrical casing, a sealed bottom, a sealed top and wherein said means for connecting the interior of said casing to both said sources includes connections through said top.

3. The combination superheater and oil separator according to claim 1 wherein said heat transfer unit comprises a coil located within the interior of said casing.

4. The combination superheater and oil separator according to claim 1 further including an oil discharge line extending to below said predetermined level and passing through said top of the casing.

5. A combination superheater and oil separator for a refrigeration system having a rotary component, a source of heated medium and a source of non-superheated refrigerant gas-oil mixture including a sealed casing, a heat transfer unit within the casing having a heat transfer surface, a connection from the interior of the casing to receive the mixture from the source, means for connecting the heat source to supply heated medium at a temperature and heat transfer rate through the heat transfer surface to boil off refrigerant gas from the mixture and produce superheated refrigerant gas, a connection on the interior of the casing to deliver superheated refrigerant gas boiled off from the mixture in the interior of said casing, and a delivery conduit to deliver oil from the casing below a predetermined level to the rotary component for lubricating the component with the nondiluted oil.

* * * * *